United States Patent [19]

Tanaka

[11] 4,192,145

[45] Mar. 11, 1980

[54] PROCESS FOR UTILIZING ENERGY PRODUCED BY THE PHASE CHANGE OF LIQUID

[75] Inventor: Seiyo Tanaka, Tokyo, Japan

[73] Assignee: Nihon Sekiyu Hanbai Kabushiki Kaisha, Tokyo, Japan

[21] Appl. No.: 844,737

[22] Filed: Oct. 25, 1977

[51] Int. Cl.[2] ..... F01K 7/00

[52] U.S. Cl. ..... 60/675; 60/641; 60/651

[58] Field of Search ..... 60/643, 653, 645, 666, 60/641, 651, 671, 675

[56] References Cited

U.S. PATENT DOCUMENTS

| | | | |
|---|---|---|---|
| 3,140,986 | 7/1964 | Hubbard | 60/641 X |
| 3,795,103 | 3/1974 | Anderson | 60/671 X |
| 3,932,995 | 1/1976 | Pecar | 60/675 X |
| 3,953,971 | 5/1976 | Parker | 60/675 X |
| 3,983,704 | 10/1976 | McFarland | 60/675 X |
| 4,100,744 | 7/1978 | De Munari | 60/651 |

*Primary Examiner*—Allen M. Ostrager
*Assistant Examiner*—Stephen F. Husar
*Attorney, Agent, or Firm*—Oldham, Oldham, Hudak & Weber Co.

[57] ABSTRACT

The present invention relates to a process for utilizing energy produced by the phase change of liquid, such as fluoronated hydrocarbon, light fraction hydrocarbon, lower alcohol and ethers using the heat coming from unused heat sources for example, the heat of the earth, the heat of hot springs, the heat of the warm waste water of factory and power plant. The present invention is applicable to transfer the heat of the unused heat source from the low place to the high place in order to use said heat for farming and cultivation at the high and cold places. The present invention is also applicable to transfer of the mass energy of the liquid from the low place to the high place by uniformly mixing the said liquid with the ascending saturated or super-saturated vapor of the said liquid.

1 Claim, 1 Drawing Figure

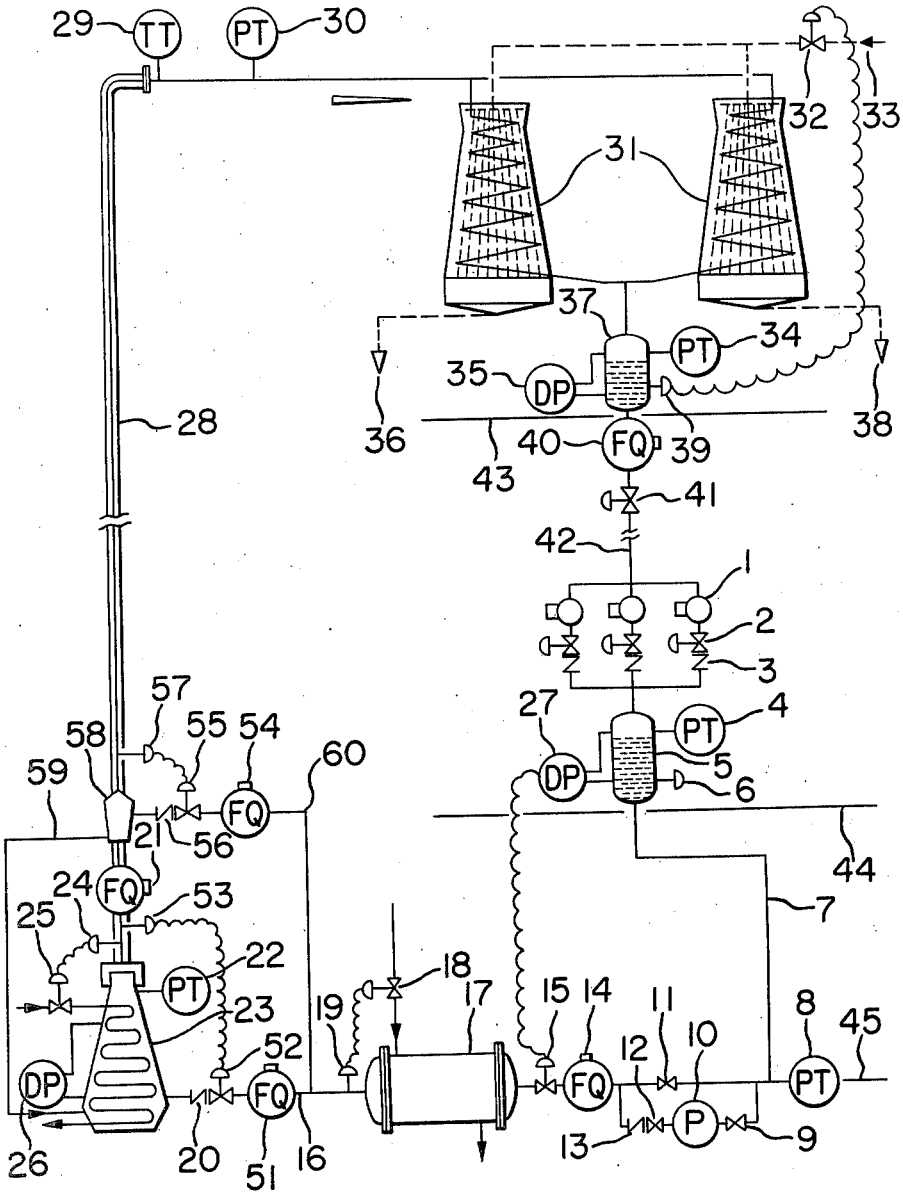
29
TT
PT
30
32
33
31
37
PT
34
35
DP
36
38
40
FQ
39
43
41
42
28
1
2
3
57
55
54
27
PT
4
58
60
DP
5
59
6
FQ
21
56
44
24
FQ
53
7
25
22
PT
18
23
17
15
14
11
8
45
19
52
12
10
DP
FQ
FQ
PT
P
13
9
26
20
51
16

PROCESS FOR UTILIZING ENERGY PRODUCED BY THE PHASE CHANGE OF LIQUID

BACKGROUND OF THE INVENTION

The present invention relates to a process and an apparatus for utilizing energy produced by the phase change of a liquid. Generally speaking, the liquid possesses the characteristic properties that the saturated vapor pressure of the liquid increases with the temperature increasement in the range of temperature between the freezing point of the liquid and the critical temperature thereof, while the saturated vapor pressure of the liquid decreases with the temperature decreasement thereof. The saturated vapor of the liquid condenses, when a pressure higher than the saturated vapor pressure of the liquid is added to the saturated vapor of the liquid, while the saturated vapor of the liquid is liquefied with the temperature decreasement of the liquid. The phase change either of the liquefaction of the vapor or the gasification of the liquid occurs depending on the interrelationship between the temperature change and the pressure change, the saturated vapor pressure of the liquid being the border therebetween. It is necessary to give the latent heat of gasifying the liquid in order to cause the phase change of gasifying the liquid and to remove the condensation heat from the vapor of the liquid to liquefy the vapor. The present invention relates to the process utilizing energy in which the principle mentioned above is applied, namely, the process relates to the process utilizing energy characterized by forming the circulating circuit comprising (a) the step of ascending the vapor of the liquid from the low place to the high place utilizing the pressure difference between the vapor pressure of the liquid generated when the liquid is vaporized by being heated at the low place and that generated when said ascending vapor of the liquid is cooled to be liquefied at the high place; (b) the step of cooling said ascending vapor at the high place to be liquefied and preferably, utilizing the heat energy of the ascending vapor when said vapor is liquefied; (c) the step of utilizing the potential energy of the liquid which has been liquefied at the high place and (d) the step of vaporizing the liquid after it has descended by repeated heating of the said liquid. The specific substance, for example, Fron-22 and Fron-500, which are the trademarks of fluoro-carbon polymers manufactured by Daikin Industrial Co. of Osaka, Japan, are vaporized within the vaporizer by the aid of the heat coming from the unused heat source, for example, the heat of the earth, the heat of hot springs, the atmospheric temperature, the solar heat, the heat of the sea water and/or the heat of the warm waste water of factory and power plant. The vapor of the specific substance ascends from the low place to the high place through the conduit connecting said high and low places by the pressure difference between the vapor pressure generated at the low place and that generated at the high place. The vapor pressure of the ascending vapor at the high place depends on the vapor pressure generated at the low place, the weight of the vapor which is the product of the height of the conduit and the density of the vapor, the loss of the vapor pressure caused by the inner resistance of the conduit and the depression of the temperature within the conduit. At that time, the phase state of the fluid within the conduit is the liquid state, the wet vapor state, the super-heated vapor state or the gaseous state, depending on both the temperature and pressure influences. The ascending vapor within the conduit at the high place is led to the heat exchanger or the cooling apparatus to be cooled by means of the atmospheric temperature, the water temperature, the wind temperature and the latent heat of evaporation of water, whereby said vapor is cooled and liquefied, the heat of the condensation being taken away through the heat exchanger or the cooling apparatus.

The temperature and the pressure of the liquid vapor to be liquefied are determined on the basis of the characteristic feature of said liquid, when the said liquid is selected taking in account of the sort of the heat source to be utilized, the temperature and the amount thereof, the cooling capacity of the heat exchanger, the diameter of the conduit, the height and the length thereof and the capacity of the heat insulation of the conduit. The more the pressure difference between the vapor pressure corresponding to the temperature of the condensed liquid at the high place and that of the ascending vapor coming from the low place becomes large, the more the amount of the ascending vapor increases. The liquid liquefied by removing the heat of the condensation through the heat exchanger or the cooling apparatus at the high place is gathered into the liquid storage tank positioned beneath the heat exchanger and then the potential energy of the descending liquid is utilized to the power source for driving the turbine while descending within the conduit, and finally the said liquid enters into the vaporizer using the unused heat source. The pressure of the liquid at the inlet of the vaporizer, after driving the turbine, is determined by the sum of (A) the product of (a) the difference of the height between the position of the liquid storage tank provided below the turbine and that of the inlet of the vaporizer and (b) the density of the liquid, and (B) the inner pressure of the said storage tank corresponding to the vapor pressure of the liquid within the liquid storage tank. As the pressure of the liquid at the inlet of the vaporizer is necessary to be higher than that within the vaporizer in order to feed the liquid into the vaporizer, it is important to determine the position of the liquid storage tank provided beneath the power plant. As occasion demands, the liquid liquefied may be fed under the pressure into the vaporizer to raise the liquid pressure by the aid of a pump.

The liquid suitable for use in the present invention demands the following phase change characteristics, from the efficiency standpoint:

(1) The relatively small latent heat of the vaporization of the liquid.

(2) The high vapor pressure, the low density and the low viscosity at the temperature of the vaporization.

(3) The low vapor pressure, the high liquid density and the low viscosity of the liquid at the temperature of the liquefaction.

(4) The high chemical and thermal stability of the liquid.

In case that the circulation circuit of the present invention for utilizing energy is used to transfer the heat energy from the low place to the high place, that is one of the objects of the present invention, it is suitable to use the liquid having the high latent heat of the vaporization.

Moreover, it is necessary to take the following characteristics (the capacity and the construction) of the apparatus of the present invention into consideration in order to select, with the good efficiency, the liquid having the characteristics suitable to the arrangement of the apparatus of the present invention, the heating medium and the amount of energy to be absorbed.

(1) The heat value to be absorbed and the temperature of the vapor in the vaporizer depending on the temperature and the amount of the heating medium in the heating and vaporizing apparatus.

(2) The heat value to be cooled and the temperature of the liquid liquefied depending on the mass and the temperature of the liquid in the cooling and liquefying apparatus.

(3) The difference of the height between the position of the vaporizer and that of the cooling and liquefaction apparatus, the diameter of the conduit, the root, the total length of the inclined conduit, the inner resistance and the heat insulating capacity of the conduit.

(4) The amount of energy to be utilized.

(5) Variations of the various factors and the surrounding conditions during all the year.

The liquid suitable to be used in the present invention comprises, for example, fluoronated hydrocarbon, chlorinated hydrocarbon, brominated hydrocarbon, fluorochloro hydrocarbon, fluorobromo hydrocarbon, light fraction hydrocarbon, lower alcohol, lower thioalcohol, lower alkyl ether, lower alkylthioether, alkylsulfoxide, toluene, xylene, or the mixture thereof and ammonia.

The circulation circuit of the present invention is used to transfer the potential energy from the low place to the high place, that is another object of the present invention.

To mainly utilize the potential energy, the liquid or the heated liquid is uniformly mixed with the saturated vapor or the super-heated vapor of the said liquid generated in the vaporizer positioned at the low place. The wet-vapor stream containing the mist of the liquid ascends from the low place to the high place by the vapor pressure of the ascending vapor. The ascending of the wet vapor stream containing the mist of the liquid is carried out by the pressure difference between the vapor pressure of said stream ascending from the low place and that of said stream at the liquifying temperature when it is liquified at the high place. The energy of the ascending vapor is converted to the potential energy by selecting and regulating the degree of drying of the ascending dry vapor to the optimum value by means of uniformly mixing the liquid or the heated liquid with the ascending dry vapor taking the said height and the temperature or pressure difference of the vapors therebetween into consideration thereby effectively utilizing energy of the ascending dry vapor at the low place, economizing energy required to condense the wet-vapor at high place, producing the large amount of the potential energy of the liquid and enhancing the utilizing efficiency of the energy held in the ascending vapor. Namely, in case that it is unneccessary to utilize the heat energy of the ascending vapor at the high place, as the process for effectively utilizing the heat energy and the ascending energy of the ascending vapor, the said liquid is uniformly mixed with the vapor coming from the vaporizer to make the wet-vapor thereby increasing the amount of transferring the liquid from the low place to the high place and relatively reducing the cooling energy for condensing the wet-vapor at the high place and producing the potential energy with good efficiency. According to the process as mentioned above, it makes possible to obtain the large potential energy in case that the distance between the low place and the high place is short, namely in said case, the utilization efficiency of the potential energy of the ascending vapor is greatly impvoed by using the wet vapor containing the mist of liquid instead of the dry vapor of liquid.

SUMMARY OF THE INVENTION

The present invention relates to a process for utilizing the heat energy and the potential energy produced by the phase change of liquid such as fluoronated hydrocarbon, light fraction hydrocarbon, lower alcohol and ethers using the heat coming from the unused heat sources such as the heat of earth, the heat of hot springs, or the heat of the warm waste water of factory and power plant.

BRIEF DESCRIPTION OF THE DRAWING

The FIGURE shows an apparatus suitable for carrying out the process of the present invention. The apparatus is the circulation circuit comprising the vaporizer, the heat exchanger which is positioned at the higher place than the said vaporizer and connected to the vaporizer, and the energy convertor arranged between the heat exchanger and the vaporizer.

DESCRIPTION OF THE PREFERRED EMBODIMENT

The present invention is explained by virtue of the figure as follows:

The liquid enters into the liquid storage tank 5 descending along the conduit 42, after driving several generators 1, through the flow control valve 2 and the check valve 3 provided the output of the turbine (generator) 1. There is arranged the detecting and controlling mechanism for controlling the liquid temperature, the pressure and the liquid surface within the tank 5 which consists of the thermoelectric couple 6, the pressure transmitter 4 and the differential pressure transmitter 27. The liquid pressure within the conduit 7 generally increased while descending the conduit 7 due to the difference in height between the height 44 of the tank 5 positioned below the turbine and the height 45 of the liquid inlet of the heating apparatus 17 and the density of the liquid and finally becomes higher than the vapor pressures generated within the heating apparatus 17 and the vaporizer 23 thereby feeding the liquid into the heating apparatus 17. The liquid descending within the conduit 7 enters into the heating apparatus 17 through the flow controlling valve 15 and the by-pass valves 11, detecting the liquid pressure within the conduit 7 by the pressure transmitter 8 and the flow rate of the liquid within the conduit 7 by means of the flow transmitter 14.

When the liquid pressure is lower than the predetermined pressure, the liquid is introduced into the heating apparatus 17 through the check valve 13 after raising the liquid pressure at the predetermined level by means of the booster 10 which is operated by closing the by-pass valve 11 and opening the control valves 9, 12 and 13. The flow rate of the liquid within the liquid storage tank 5 is controlled so as to maintain the liquid level within the tank 5 to the constant level by the linkage of the differential transmitter 27 and the flow regulating valve 15 arranged at the inlet of the heating apparatus 17. The liquid entering into the heating apparatus 17 is heated to the requisite temperature by the warm waste water exhausted from the factory and the power plant, the hot steam spouting out from the earth, the heat of the hot springs and/or the warm wind. The temperature of the wet steam spouting out from the outlet of the heating apparatus 17 is controlled to be the predetermined level by regulating the flow rate of the heating medium which is fed into the heating apparatus 17 by means of the control valve 18 according to the indication of the thermocouple 19.

The liquid heated to the predetermined temperature enters into the vaporizer 23 through the flow controlling valve 52 and the check valve 20 detecting the flow rate of the liquid within the conduit 16 by means of the flow transmitter 51 and vaporizes. The temperature and the pressure of the vaporizing liquid are detected by means of the thermocouple 24 and the pressure transmitter 22 provided at the outlet of the vaporizer 23 is controlled so as to become the requisite pressure by means of the control valves 24, 25 and 53.

The surface of the liquid within the vaporizer 23 is detected by the differential transmitter 26, and the flow rate of the vaporizing liquid at the outlet of the vaporizer 23 is detected by means of the flow transmitter 21. The vaporizing liquid coming from the vaporizer 23 ascends to the predetermined level within the conduit 28 by the aid of the pressure of the vaporizing liquid.

In order to mainly utilize the potential energy of the liquid, the liquid coming from the heating apparatus 17 is fed into the gas-liquid mixer 58 through the conduit 60 andthe check valve 56 in order to uniformly mix the said liquid with the ascending dry vapor coming from the vaporizer 23. The amount of the liquid fed to the said mixer 58 is regulated by means of the flow transmitter 54, the flow control valve 55 and the thermo-electric couple 57 provided at the outlet of the mixer 58. The liquid condensed in the mixer 58 is recycled into the vaporizer 23 through the conduit 59. The wet vapor containing the mist of the liquid ascends to the predetermined level within the conduit 28 and then condenses by means of the cooling apparatus 31 thereby making it possible to transfer the large amount of the liquid accompanied by the ascending dry vapor from the low place to the high place.

The conduit 28 is the conduit having the double structure in which the vapor passage of the liquid is provided in the inside of said double structure and the adiabatic heat insulator is provided outside of said double structure and further the means for keeping it warm is provided at the outside of the conduit 28. The temperature and the pressure of the vapor of the liquid at the predetermined level within the inside passage of the double structure of the conduit 28 are detected by means of the thermocouple 29 and the pressure transmitter 30 respectively. The conduit 28 is connected with the cooling apparatus 31 by means of the naked pipe which generally descends toward the cooling apparatus 31 from the top of the conduit 28.

The cooling apparatus 31 is constructed, for example, so as to raise the cold atmospheric air from the bottom thereof and spread the cooling water from the top thereof through the pipe 33, thereby cooling the temperature of the gas-liquid mixture flowing within the pipe provided within the said cooling apparatus and liquefying said mixture by removing the condensation heat and then introducing the liquid into the tank 37. The temperature, the pressure and the surface of the liquid are detected by the means of the thermocouple 39, the pressure transmitter 34 and the differential pressure transmitter 35.

The liquid temperature within the tank 37 is regulated through the thermo-electric couple 39 and the control valve 32 to control the flow rate of the cooling water. As the cooling water flows out as the warm water from the outlets 36, 38 provided at the bottom of the cooling apparatus 31 after having passed through the cooling apparatus 31, the said warm water is used for another service or recycle as to heat an object 37. The liquid pressure at the inlet of the turbine is determined according to the difference of the height between the position 43 of the tank 37 and that 44 of the generator 1, the density of the liquid and the pressure within the tank 37. The amount of the liquid entering into the turbine of the generator 1 is determined so as to be the predetermined level by regulating the amount of the liquid entering into the tank 37 and the surface of the liquid within the tank 37 and is controlled by the linkage of the control valve 41 provided at below the tank 37 and the differential transmitter 35 for detecting the liquid surface within the tank 35. The flow rate of the liquid is detected through the flow transmitter 40, and the number of the operative generator (or the turbine 1) is determined according to the flow rate of the liquid which is fed to the generator 1.

As occasion demands, the thermal insulating processing can be applied to the descending conduit 42 connected from the tank 37 to the generator 1 in order to prevent the influence of the temperature variation due to the atmosphere. The liquid within the tank 37 does not gasify since the pressure within the tank 37 is balanced with the vapor pressure of the liquid corresponding to the temperature of the liquid entering into the tank 37.

As the liquid pressure descending within the conduit 42 increases, even if the liquid within the conduit 42 is heated, the liquid does not gasify within the tank 5 since the inner pressure of the tank 5 is balanced with the vapor pressure of the liquid corresponding to the temperature of the liquid entering into the tank 5, but the pressure of the tank 5 acts upon the outlet of the turbine or generator 1. The present invention is explained by way of the following examples but not to be limited to the examples.

EXAMPLE 1

Fron-500 (Dichlorodifluoro methane-Difluoro ethane mixture) ($CCl_2F_2$—$C_2H_4F_2$:73.8/26.2 wt%) is used as the liquid in the example 1.

The thermodynamics properties of Fron-500 are shown as follows:

| | |
|---|---|
| Molecular weight | 99.31 |
| Boiling point | −33.3 |
| Freezing point | −158.9 |
| Critical temperature | 105.1 |
| Critical pressure | 44.4 atm. |
| Critical density | 0.498 |
| Specific heat | liquid (25° C.) 0.29 Cal/g. |
| | vapor (30° C.) 0.13 Cal/g. |
| Viscosity | liquid (−15° C.) 0.292 Centipoise |
| | vapor (30° C., latm) 0.222 Centipoise |

(1) One of the trial balances is shown as follows:

Fron-500 was introduced into the vaporizer at the temperature of 20° C. and vaporized by the warm water of 90° C. to obtain the vapor of 50° C. The necessary amount of the heat was 43.81 Kcal/kg. The vapor pressure of the saturated vapor at the temperature of 50° C. was 14,793 kg/cm$^2$ abs. Now, when the vapor of Fron-500 ascends to 700 m in height within the straight conduit having vacuum room between the walls of the double structure of the conduit and the heat insulating layer around the outside of the said conduit, the vapor density of the liquid at 50° C. was 70.1 kg/cm$^2$. The weight of the vapor of the liquid within the conduit amounts to 4.907 kg/cm$^2$ (70.1 kg/cm$^3$×700 m). The vapor pressure of the liquid at 700 m in height depresses to 9.886 kg/cm$^2$ abs. While, when the vapor of Fron-500 is cooled to 20° C. and liquefied at 700 m in height by means of the cooling apparatus, the vapor pressures within the cooling apparatus and the liquid storage tank depresses to 6.849 kg/cm$^2$ abs. which corresponds to the pressure lower than that of the ascending vapor (namely 9.886 kg/cm$^2$) by that of more than 2 kg/cm$^2$ at the high place, whereby the vapor of the liquid ascends to 700 m in height within the conduit. There is discharged the necessary amount of the heat of 43.79 kcal/kg which corresponds to the amount of the heat necessary to cool the vapor of Fron-500 to the liquid of 20° C. at 700 m in height. Namely, it results in transfering from the low place to the high place of the amount of the heat which is almost same to that given at the low place. As is continuously transfered from the low place to the high place the heat coming from the unused heat source having far lower temperature than that necessary to utilize to the conventional geothermal generator according to the process for utilizing energy of the present invention, it makes it possible to effectively utilize the heat of said unused heat source to farming and cultivation at the high and cold places.

(2) The second one of the trial balances is shown as follows:

When the cooling and liquefying temperature of the liquid amounts to 40° C., since the environment temperature at the high place ascends in the summer, the vapor pressure of the liquid amounts to 22.910 kg/cm$^2$ at the vaporizing temperature of 70° C. at the low place (the ground), while the vapor pressure of the liquid descends to 14.678 kg/cm$^2$ at the high place of 700 m. When the vapor of the liquid was cooled to 40° C. and liquefied, the vapor pressure of the liquid amounts to 11.639 kg/cm$^2$. Therefore, the differential pressure between the vapor pressure (14.678 kg/cm$^2$) and that (11.639 kg/cm$^2$) at the temperature of 40° C. reaches to more than 3 kg/cm$^2$ thereby making it possible to ascend the large amount of the vapor of the liquid to the high place. As shown above, it makes possible to alter and regulate the temperature of the vaporization according to the cooling temperature, the cooling capacity and the amount of the liquid to be treated, the environment temperature, the wind temperature and the water temperature. When Fron-500, which has entered into the liquid storage tank at the high place after liquefying, descends within the conduit 42, since the density of the liquid is 1.175 kg/l at 20° C., 1.103 kg/l at 40° C. respectively, the amount of the work for driving the turbine is determined on the basis of the height of the descending liquid, the density of the liquid, the inner pressure of the liquid storage tank at the high place and the liquid flow rate. The liquid of Fron-500 enters into the liquid storage tank at the low place after driving the turbine. At that time, the inner pressure of the liquid storage tank amounts to 6.849 kg/cm$^2$ at the liquid temperature of 20° C., 11.639 kg/cm$^2$ at 40° C. respectively, while the inner pressure of the vaporizer amounts to 14.793 kg/cm$^2$ at 50° C., 22.91 kg/cm$^2$ at 20° C. respectively, so that the differential pressure between the inner pressure of the vaporizer and that of the liquid storage tank results in 7.944 kg/cm$^2$ and 11.271 kg/cm$^2$ respectively. The distance or the height (7) between the position of the vaporizer 23 and that of the liquid storage tank 5 provided at the outlet of the turbine 1 is necessary to be 67.6 m at 20° C., and more than 102 m at 40° C. respectively whereby the available height for driving the turbine results in less than 632.4 m and 598 m respectively. If the pump 10 for ascending the pressure is used to increase the pressure difference, it is possible to use the head of 600 m and the liquid pressure of 70 kg/cm$^2$−63 kg/cm$^2$ at the inlet of the turbine to drive the turbine.

(3) The third one of the trial balances is shown as follows:

Now Fron-500 (liquid) is vaporized at the rate of 1,000 kg/sec. giving the amount of the heat to the liquid at the rate of about 43,810 k cal/sec. by means of the heating apparatus 17 provided on the ground. When the liquid ascends to the height of 700 m within the straight conduit 28 having the inner diameter of 100 cm as the liquid vapor of 50° C., the flow rate of the vapor reaches to 18.2 m/sec. and the head loss due to the internal resistance of the conduit reaches to 500 mm aq. In order to ascend the liquid to the height of 700 m, the pressure difference of more than 5 kg/cm$^2$ is required taking account of the weight of the vapor due to the height of 700 m and the said head loss. As mentioned above, when the vapor of the liquid is cooled to 20° C. and liquefied at the high place of 700 m, taking the amount of the heat by force at the rate of about 43,790 kcal/sec., the vapor pressure at the high place reaches to 6.849 kg/cm$^2$, while the inner pressure of the vaporizer 23 at 50° C. amounts to 14.793 kg/cm$^2$, so that the pressure difference between the high place and the outlet of the vaporizer amounts to 7.944 kg/cm$^2$. The effective pressure difference amounts to 2.944 kg/cm$^2$ after deducting the head loss of 5 kg/cm$^2$ thereby sufficiently compensating the head loss within the cooling apparatus 31. When the liquid Fron-500 descends to the inlet of the turbine 1 which is positioned beneath 600 m from the tank positioned at the high place at the rate of 1000 kg/sec., if the liquid temperature of the said tank 37 provided at the high place is the same as that of the tank 5 provided at the outlet of the turbine, the electric power generated by driving the turbine 1 due to the balance of the pressure difference between the said both tanks is estimated to be about 5,000 kw/hr at the efficiency of 85%.

EXAMPLE 2

In case that Fron-22 (Monochlorodifluoromethane) is used as the liquid, when Fron-22 is vaporized by heating at 5° C. using the heat of the sea water in which the average temperature of the sea water in the Japan Black warm stream is +10° C., the saturated vapor pressure of Fron-22 is 5.953 kg/cm$^2$ abs. If said saturated vapor ascends to the high place of 500 m from the ground within the conduit 28, the total head loss resulted from the ascent of the vapor within the conduit 28 amounts to 1.24 kg/cm$^2$ due to the vapor density of 24.76 kg/m$^3$ and the difference of the height and the head loss within the conduit.

Assuming that the temperature of the ascending vapor does not change while ascending, the vapor pressure at the height of 500 m amounts to 4.713 kg/cm$^2$ (5,953 kg/cm$^2$−1.24 kg/cm$^2$).

If the ascending vapor is cooled to −10° C. in the cooling apparatus by means of the cold wind of −20° C. at the wind velocity of 10 m/sec. the vapor pressure of the cold fluid amounts to 3.613 kg/cm$^2$.

As the pressure difference between the vapor pressure within the vaporizer and that within the cooling apparatus amounts to 1.1 kg/cm$^2$ after deducting the head loss of 1.24 kg/cm$^2$ resulted from the inner resistance of the fluid within the conduit, it makes possible to cycle the fluid into the circulating system of the present invention.

Now, if the liquid Fron-22 lying at the height of 500 m descends to the place below the distance of 480 m in order to introduce it to the turbine positioned at 20 m in height from the ground, the liquid pressure results in 63.2 kg/cm$^2$ thereby driving the turbine. If the liquid temperature within the tank positioned at the outlet of the turbine is −10° C., the inner pressure within the tank positioned at 20 m in height from the ground amounts to 3.613 kg/cm$^2$.

If the said liquid pressure is calculated on the basis of the surface of the sea water, the liquid pressure within the liquid storage tank amounts to 6.249 kg/cm$^2$ adding the liquid pressure of 2.636 kg/cm$^2$ which corresponds to the liquid pressure existing between the positions of the tank on the ground and the surface of the sea water. While, as the inner pressure within the vaporizer positioned into the sea water is 5.953 kg/cm$^2$, it makes possible to feed the liquid into the vaporizer thereby completing the circulation.

The effects of the present invention are explained as follows:

(1) In the practice of the present invention, by selecting the appropriate liquid to be used and utilizing the temperature difference between the temperature of the sea water in the Japan Black warm stream of about 10° C. and that of the cold wind of less than −20° C. with the wind velocity of more than 10 m/sec. which blows at the top of the Japan Alps, the turbine generator will be driven according to the circulating circuit of the present invention.

(2) As the heating sources, the steam, the warm water, the heat of the earth, the solar heat, the heat of the hot springs, the atmospheric temperature and/or the wind temperature are used.

(3) By selecting the liquid to be used, various kinds of the heating source and the cooling source are utilized.

(4) If the heat energy is transfered from the low place to the high place to raise the temperature of the river water and the lake water indicated at 37, existing at the high place, it contributes to rear and cultivate the agricultural products and the fish farming.

(5) It can be utilized the natural phenomena of the cold temperature and the minor temperature difference between the natural phenomena and the atmospheric temperature.

What is claimed is:

1. Process for utilizing energy produced by the phase change of a liquid comprising the working fluid characterized in that a step of ascending the vapor of the liquid from a low place to a high place utilizing the difference of the vapor pressure of the liquid between the vapor pressure generated when said liquid is vaporized by heating it at the low place and that generated when the said ascending vapor of the liquid is cooled to liquify it at the high place;

a step of cooling said ascending vapor at the high place to liquify it and preferably to utilize the heat energy of the ascending vapor when said vapor is liquified;

a step of utilizing the potential energy of the descending liquid by letting the liquid fall which has been liquified at the high place;

astep of vaporizing the liquid descended by repeatedly heating the liquid; and characterized in that the liquid is uniformly mixed with the saturated or the super-heated ascending vapor and the resulting vapor containing the mist of the said liquid is transferred from the low place to the high place.

* * * * *